US006401992B1

(12) United States Patent
Harrod et al.

(10) Patent No.: US 6,401,992 B1
(45) Date of Patent: Jun. 11, 2002

(54) SHORT SLEEVE SHIRT PRESS ADAPTER

(75) Inventors: Michael K. Harrod, Valrico; John Wagner, Zephyrhills, both of FL (US)

(73) Assignee: Unipress Corporation, Tampa, FL (US)

( * ) Notice: Subject to any disclaimer, the term of this patent is extended or adjusted under 35 U.S.C. 154(b) by 4 days.

(21) Appl. No.: 09/761,027

(22) Filed: Jan. 16, 2001

Related U.S. Application Data

(60) Provisional application No. 60/227,500, filed on Aug. 24, 2000.

(51) Int. Cl.[7] ..... D06C 15/00
(52) U.S. Cl. ..... 223/73; 223/72
(58) Field of Search ..... 223/72, 73, 74, 223/68, 69, 70

(56) References Cited

U.S. PATENT DOCUMENTS

| | | | | |
|---|---|---|---|---|
| 3,654,714 | A | 4/1972 | North | 38/16 |
| 3,679,106 | A | 7/1972 | North et al. | 223/73 |
| 3,715,064 | A | 2/1973 | North et al. | 223/57 |
| 3,934,766 | A | 1/1976 | Bailey | 223/73 |
| 4,057,179 | A | 11/1977 | Everett | 223/73 |
| 4,163,331 | A | 8/1979 | Renaut | 38/12 |
| 4,346,826 | A | 8/1982 | Ehemann | 223/70 |
| 4,349,137 | A | 9/1982 | Everett | 223/73 |
| 4,634,030 | A | 1/1987 | Uchikoshi | 223/57 |
| 4,843,745 | A | 7/1989 | Oberley | 38/34 |
| 4,910,894 | A | 3/1990 | Vartan | 38/30 |
| 5,012,962 | A | 5/1991 | Oberley et al. | 223/57 |
| 5,065,535 | A | 11/1991 | Gill et al. | 38/22 |
| 5,419,469 | A | 5/1995 | Urso | 223/70 |
| 5,474,216 | A | 12/1995 | Harrod et al. | 223/57 |
| 5,636,773 | A | 6/1997 | Harrod et al. | 223/57 |
| 5,692,326 | A | 12/1997 | Mohan et al. | 38/7 |
| 5,732,859 | A | 3/1998 | LeBlanc | 223/67 |
| 6,186,377 | B1 * | 2/2001 | McCormick et al. | 223/68 |

* cited by examiner

*Primary Examiner*—Bibhu Mohanty
(74) *Attorney, Agent, or Firm*—Holland & Knight, LLP

(57) ABSTRACT

A method and an apparatus for finishing a garment comprising, in combination a buck in the general form of a wearer having a front, a back and opposite lateral sides therebetween and adapted to hold at least a front and back of the garment in an orientation for being pressed. A pair of elongated arms are positioned on opposite lateral sides of the buck, the elongated arms extending away from the buck to finish the sleeve of the garment and contracting towards the buck to load and unload the garment. A long sleeve garment is finished through the use of a clip positioned at an upper end of each of the elongated arms. The clips are formed with resiliently urged fingers and adapted to receive an area of the long sleeve garment and form an obstruction for the flow of heated air and steam therethrough during a finishing operation. In the alternative, a clamp is provide along the length of each of the elongated arms to finish a short sleeve garment on the same pressing apparatus. Each of the clamps has a resiliently urged end adapted to receive an area of the short sleeve garment and form an obstruction for the flow of heated air and steam therethrough during the finishing operation, whereby the pressing apparatus may be used to press long sleeve garments and alternatively, upon use of the clamps, short sleeve garments.

18 Claims, 5 Drawing Sheets

SHORT SLEEVE SHIRT PRESS ADAPTER

CROSS REFERENCE TO RELATED APPLICATIONS

This application is a utility application based upon and claiming priority of provisional application number 60/227,500, filed Aug. 24, 2000, the disclosure of which is incorporated by reference herein.

BACKGROUND OF THE INVENTION

1. Field of the Invention

This invention relates to a method and an apparatus for concurrently pressing the front, back and sleeves of both long and short sleeve garments on the same pressing machine.

2. Description of the Background Art

Presently, in the field of finishing shirts, three separate machines are normally utilized. The first machine is for pressing the collars and cuffs. The second machine is for finishing the sleeves. The third machine is for pressing the body of the shirt. A continuing effort is being made to increase the efficiency of the shirt finishing process by minimizing the number of machines necessary for the finishing and by simplifying the machines. By way of example, consider U.S. Pat. No. 3,654,714 to North directed to a steam-air garment press; U.S. Pat. No. 3,679,106 to Beckett directed to a control system for garment finishing apparatus; U.S. Pat. No. 3,715,064 to Eubank directed to a garment finishing apparatus; U.S. Pat. No. 4,634,030 to Uchikoshi directed toward a laundry presser for simultaneously pressing multiple clothing sections; U.S. Pat. No. 4,843,745 to Oberlye directed toward a press and method of making same; U.S. Pat. No. 5,012,962 to Downie directed toward an indexing mechanism for a mannequin carriage having a slidable, pivotable support and index bar moveable by a fluid cylinder for movement between a dressing position and a garment press; U.S. Pat. No. 5,065,535 to Gill directed toward an indexing system for rotary garment press; U.S. Pat. No. 5,474,216 to Harrod et al. directed toward a method and apparatus for concurrently pressing the front and back of a shirt and finishing the sleeves through the use of air pressure; U.S. Pat. No. 5,636,773 to Harrod et al. directed toward a method and apparatus for finishing the sleeves and pressing the body of a shirt in combination with an integrated collar cuff presser; and lastly, U.S. Pat. No. 5,692,326 to Mohan et al. directed toward a shirt pressing apparatus with movable cuff clamps.

Therefore, there exists a need in the art to improve and preserve the quality of a short sleeve garment, improve operator efficiency and reduce operator fatigue while providing a short sleeve clamping mechanism for a garment pressing machine which adapts to varied lengths of sleeves.

Nothing in the prior art provides the benefits attendant with the present invention.

Therefore, it is an object of the present invention to provide an improvement which overcomes the inadequacies of the prior art devices and which is a significant contribution to the advancement of the art.

Another object of the present invention is to press the front and back of a garment while concurrently finishing both short and long sleeves.

Yet another object of the present invention is to provide a first stopping pin for positioning each of the rotatable clamps in a retracted position on each of the elongated arms, and a second stopping pin for positioning each of the rotatable clamps in a loading position on each of the elongated arms.

Still yet another object of the present invention is to provide a pressing apparatus where the pair of elongated arms are extended through gravity to a pressing position and contracted through a piston to a loading position.

Another object of the present invention is to provide a pressing apparatus that uses a clip to effectively finish long sleeve garments and a rotatable clamp to effectively finish short sleeve garments.

It is a further object of the present invention to increase the efficiency, simplicity and safety of garment finishing machines while reducing the cost through reduced equipment.

It is yet another object of the present invention to provide a new and improved pressing apparatus for finishing a sleeve of a garment comprising, in combination, a buck in the general form of a wearer having a front and a back and opposite lateral sides therebetween and adapted to hold at least a front and back of the garment in an orientation for being pressed; a pair of elongated arms positioned on opposite lateral sides of the buck, said elongated arms extending away from said buck to finish the sleeve of the garment and said elongated arms contracting towards said buck to load and unload the garment; a clip positioned at an upper end of each of said elongated arms, each of said clips being formed with resiliently urged fingers and adapted to receive an area of a long sleeve of the garment on the buck to be finished at the region at the end of the long sleeve to form an obstruction for the flow of heated air and steam therethrough during a finishing operation; and a clamp positioned along the length of each of said elongated arms, each of said clamps having a resiliently urged end adapted to receive an area of a short sleeve of the garment on the buck to be finished at the region at the end of the short sleeve to form an obstruction for the flow of heated air and steam therethrough during the finishing operation, whereby the pressing apparatus may be used to press long sleeve garments and alternatively, upon use of the clamps, short sleeve garments.

It is another object of the present invention to provide a new and improved pressing apparatus of the type in which a buck is adapted to hold at least a front and back of a long sleeve garment, and in which a clip is positioned at an upper end of a pair of elongated arms that extend the sleeves of the long sleeve garment away from opposite sides of the buck, wherein the improvement comprises a clamp positioned along the length of each of the elongated arms, each of said clamps having a resiliently urged end adapted to receive an end of a short sleeve of a short sleeve garment to form an obstruction for the flow of heated air and steam therethrough during a finishing operation, whereby the pressing apparatus may be used to press long sleeve garments and alternatively, upon use of the clamps, short sleeve garments.

It is a further object of the present invention to provide a new and improved method of pressing a garment wherein a long sleeve garment is placed on a buck adapted to hold at least a front and back of the long sleeve garment, and each of the long sleeves of the long sleeve garment are extended away from opposite sides of the buck through a clip positioned at an upper end of a pair of elongated arms, the improvement comprising contracting the pair of elongated arms towards said buck; placing a short sleeve garment having a pair of short sleeves onto the buck; positioning a clamp on each of the elongated arms into a load position, said clamps being positioned along the length of the pair of elongated arms; placing an end of each of the short sleeves of the short sleeve garment into the respective clamp;

extending the pair of elongated arms away from said buck; flowing heated air and steam through the short sleeve garment during a finishing operation; and contracting the pair of elongated arms towards said buck to unload the short sleeve garment.

It is another object of the present invention to provide a new and improved method for finishing a pair of sleeves on a garment comprising the steps of providing a buck in the general form of a wearer having a front and a back and opposite lateral sides therebetween and adapted to hold at least a front and back of the garment in an orientation for being pressed; providing a pair of elongated arms positioned on the opposite lateral sides of the buck; contracting said pair of elongated arms towards said buck; placing an end of each long sleeve of a long sleeve garment in a clip positioned at an upper end of each of said elongated arms, extending said pair of elongated arms away from said buck; flowing heated air and steam through the long sleeve garment during a finishing operation; contracting said pair of elongated arms towards said buck to unload the long sleeve garment; placing an end of each short sleeve of a short sleeve garment in a clamp positioned along the length of each of said elongated arms; extending said pair of elongated arms away from said buck; flowing heated air and steam through the short sleeve garment during the finishing operation; and contracting said pair of elongated arms towards said buck to unload the short sleeve garment.

The foregoing has outlined some of the pertinent objects of the present invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a method and an apparatus for concurrently pressing the front and back and sleeves of both long and short sleeve garments on the same pressing apparatus through the use of a rotatable clamp.

A feature of the present invention is to press the front and back of a garment while concurrently finishing both short and long sleeves.

Yet another feature of the present invention is to provide a first stopping pin for positioning each of the rotatable clamps in a retracted position on each of the elongated arms, and a second stopping pin for positioning each of the rotatable clamps in a loading position on each of the elongated arms.

Another feature of the present invention is to provide a pressing apparatus where the pair of elongated arms are extended through gravity to a pressing position and contracted through a piston to a loading position.

Still another feature of the present invention is to provide a pressing apparatus that uses a clip to effectively finish long sleeve garments and a rotatable clamp to effectively finish short sleeve garments.

Still yet another feature of the present invention is to increase the efficiency, simplicity and safety of garment finishing machines while reducing the cost through reduced equipment.

Another feature of the present invention is to provide a new and improved pressing apparatus for finishing a sleeve of a garment comprising, in combination a buck in the general form of a wearer having a front and a back and opposite lateral sides therebetween and adapted to hold at least a front and back of the garment in an orientation for being pressed. A pair of elongated arms are positioned on opposite lateral sides of the buck. These elongated arms are extended away from the buck to finish the sleeve of the garment that has been placed on the buck. These same elongated arms are contracted towards the buck to load and unload the garment that is to be pressed. A clip is positioned at an upper end of each of the elongated arms, each of the clips are formed with resiliently urged fingers which are adapted to receive an area of a long sleeve of the garment on the buck to be finished at the region at the end of the long sleeve. The resiliently urged fingers of each clip form an obstruction in the flow of heated air and steam therethrough during a finishing operation allowing the long sleeves of the garment to be finished at the same time as the front and back of the garment. In addition, a rotatable clamp is positioned along the length of each of the elongated arms, each of the rotatable clamps have a resiliently urged end adapted to receive an area of a short sleeve of the garment on the buck to be finished at the region at the end of the short sleeve. The resiliently urged end of each clamp forms an obstruction in the flow of heated air and steam therethrough during a finishing operation allowing the short sleeves of the garment to be finished at the same time as the front and back of the garment. Whereby the pressing apparatus may be used to press long sleeve garments and alternatively, upon use of the rotatable clamps, short sleeve garments.

Still another feature of the present invention is to provide a new and improved pressing apparatus of the type in which a buck is adapted to hold at least a front and back of a long sleeve garment. The long sleeve is held in a clip which is positioned at an upper end of a pair of elongated arms that extend the sleeves of the long sleeve garment away from opposite sides of the buck. The improvement comprises a rotatable clamp positioned along the length of each of the elongated arms. Each of the rotatable clamps has a resiliently urged end that is adapted to receive an end of a short sleeve of a short sleeve garment. The resiliently urged end of each clamp forms an obstruction in the flow of heated air and steam therethrough during a finishing operation allowing the short sleeves of the garment to be finished at the same time as the front and back of the garment. Whereby the pressing apparatus may be used to press long sleeve garments and alternatively, upon use of the clamps, short sleeve garments.

Another feature of the present invention is to provide a new and improved method of pressing a garment wherein a long sleeve garment is placed on a buck adapted to hold at least a front and back of the long sleeve garment. Each of the long sleeves of the long sleeve garment are extended away from opposite sides of the buck through a clip positioned at an upper end of a pair of elongated arms. The improved method comprises the steps of contracting the pair of elongated arms towards the buck. Placing a short sleeve garment on the buck. Rotating a clamp that is positioned along the length of each of the elongated arms into a load position. The rotatable clamp having a resilient urged end. Placing an end of each of the short sleeves of the short sleeve garment into the resilient urged end of the respective clamp. The pair of elongated arms are extended away from the buck to extend the short sleeves of the short sleeve garment into a finishing position. Heated air and steam are flown through the short sleeve garment during the finishing operation. The pair of elongated arms are contracted towards the buck in order to unload the short sleeve garment from the pressing apparatus.

Still another feature of the present invention is to provide a new and improved method for finishing a pair of sleeves on a garment comprising the steps of providing a buck in the general form of a wearer having a front, a back and opposite lateral sides therebetween. The buck is adapted to hold at least a front and back of the garment in an orientation for being pressed. A pair of elongated arms are provided that are positioned on the opposite lateral sides of the buck. The pair of elongated arms are contracted towards the buck in order to the load the a long sleeve garment for pressing. An end of each long sleeve of the long sleeve garment is placed in a clip positioned at an upper end of each of the elongated arms. The pair of elongated arms are extended away from the buck to extend the long sleeves of the long sleeve garment into a finishing position. Heated air and steam are flown through the long sleeve garment during the finishing operation. The pair of elongated arms are contracted towards the buck in order to unload the long sleeve garment from the pressing apparatus. In the alternative, a short sleeve garment is placed on the buck for pressing. An end of each short sleeve of the short sleeve garment is placed in a rotatable clamp that is positioned along the length of each of the elongated arms. The pair of elongated arms are extended away from the buck to extend the short sleeves of the short sleeve garment into a finishing position. Heated air and steam are flown through the short sleeve garment during the finishing operation. The pair of elongated arms are contracted towards the buck in order to unload the short sleeve garment from the pressing apparatus.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The invention will become more readily apparent from the following description of preferred embodiments thereof shown, by way of example only, in the accompanying drawings wherein.

Similar reference characters refer to similar parts throughout the several views of the drawings.

DETAILED DESCRIPTION OF THE INVENTION

Figure 1:
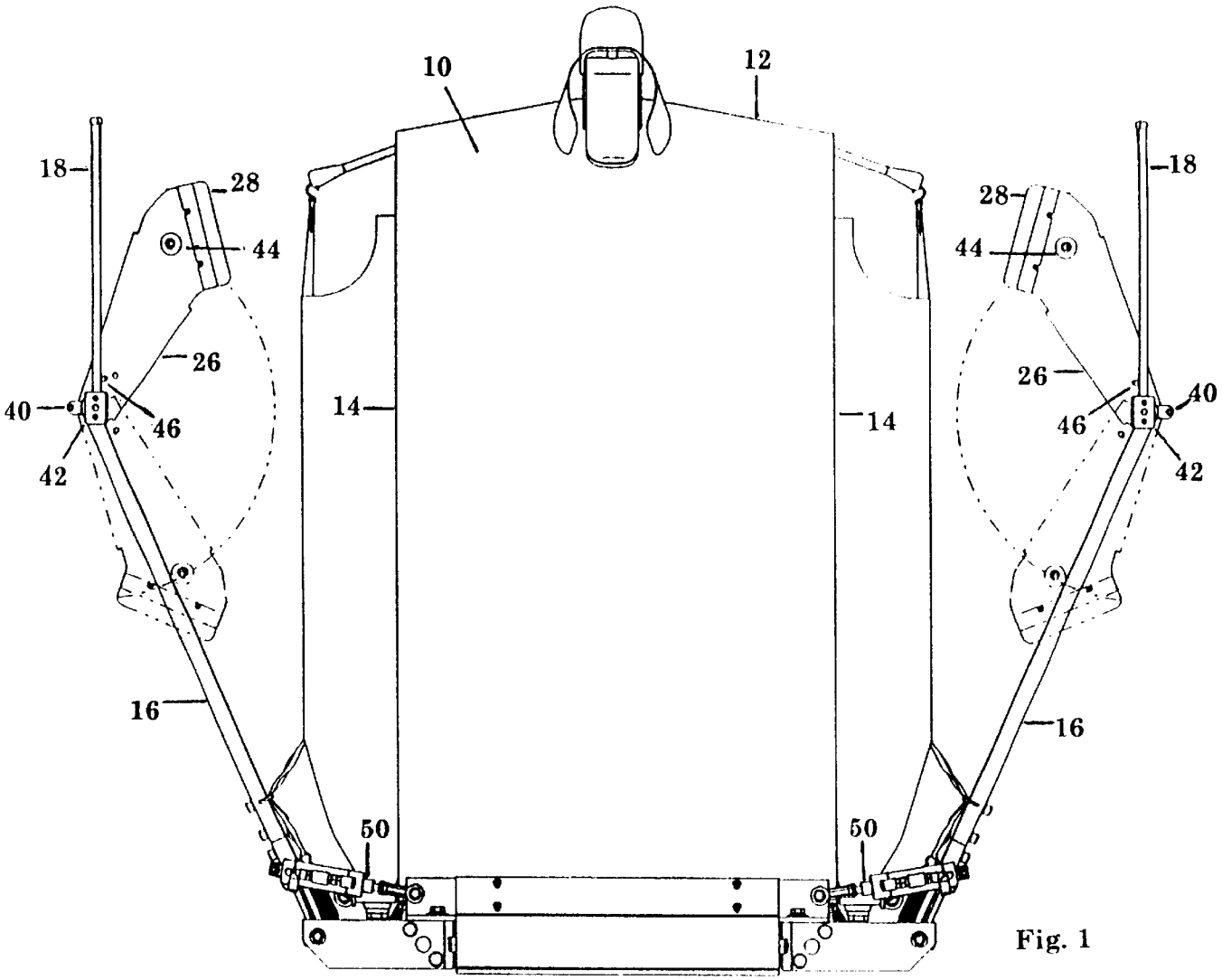
FIG. 1 is a perspective view of the preferred embodiment of the new and improved apparatus for pressing both short and long sleeve garments on the same pressing apparatus.

Reference will now be made to the drawings. FIG. 1 is a perspective illustration providing an overview of the entire apparatus 10. The apparatus 10 has as its main component a buck 12. The buck 12 is in the general form of a wearer of a shirt or blouse. The buck 12 has a contoured front and a contoured back and opposite lateral sides 14 therebetween. The buck 12 is adapted to hold at least the front and back of a garment to be finished in an orientation for being pressed.

The buck 12 is mounted from beneath for movement between a loading zone and a finishing zone. The buck 12 has a neck clamp in the neck area for the collar of the shirt to be pressed. The buck 12 also has two short shoulder rods. Such shoulder rods are for holding the shoulders of the garment in proper orientation during the finishing operation.

Also provided on the buck 12 are a pair of long sleeve arm clips 18. These clips 18 are for receiving the cuffs 24 of the longs sleeves 22 of a long sleeve garment 20 to be pressed. The clips 18 receive the area of the long sleeve 22 where the end of the long sleeve 22 and cuff join 24. The clips 18 are formed with resiliently urged fingers at their upper ends. These fingers are adapted to receive the appropriate area of the long sleeve garment 20 on the buck 12 to be finished.

The clips 18 form an obstruction for the flow of heated air and steam therethrough during the finishing operation to effect an appropriate finishing of the long sleeve garment 20.

The present invention is an improved pressing apparatus. It allows the user to press long sleeve garments and short sleeve garments on the same pressing apparatus.

As shown in FIG. 1, in a preferred embodiment, each clamp 26 connects to the respective elongated arm 16 through a joint 40 positioned at a point of transition 42 on each of the elongated arms 16. A first stopping pin 44 is placed on each clamp 26 for ease of positioning each clamp 26 in a retracted position on each of the elongated arms 16. A second stopping pin 46 is placed on each clamp 26 for positioning each clamp 26 in a loading position on each of the elongated arms 16.

The pair of elongated arms 16 are extended away from the opposite sides 14 of the buck 12 through gravity. In this position the garment on the buck is in a pressing position since the sleeves of the garment are extended away from the garment. To load or unload a garment, the pair of elongated arms 16 are contracted towards the opposite sides 14 of the buck 12 through a piston 50.

Figure 2A:
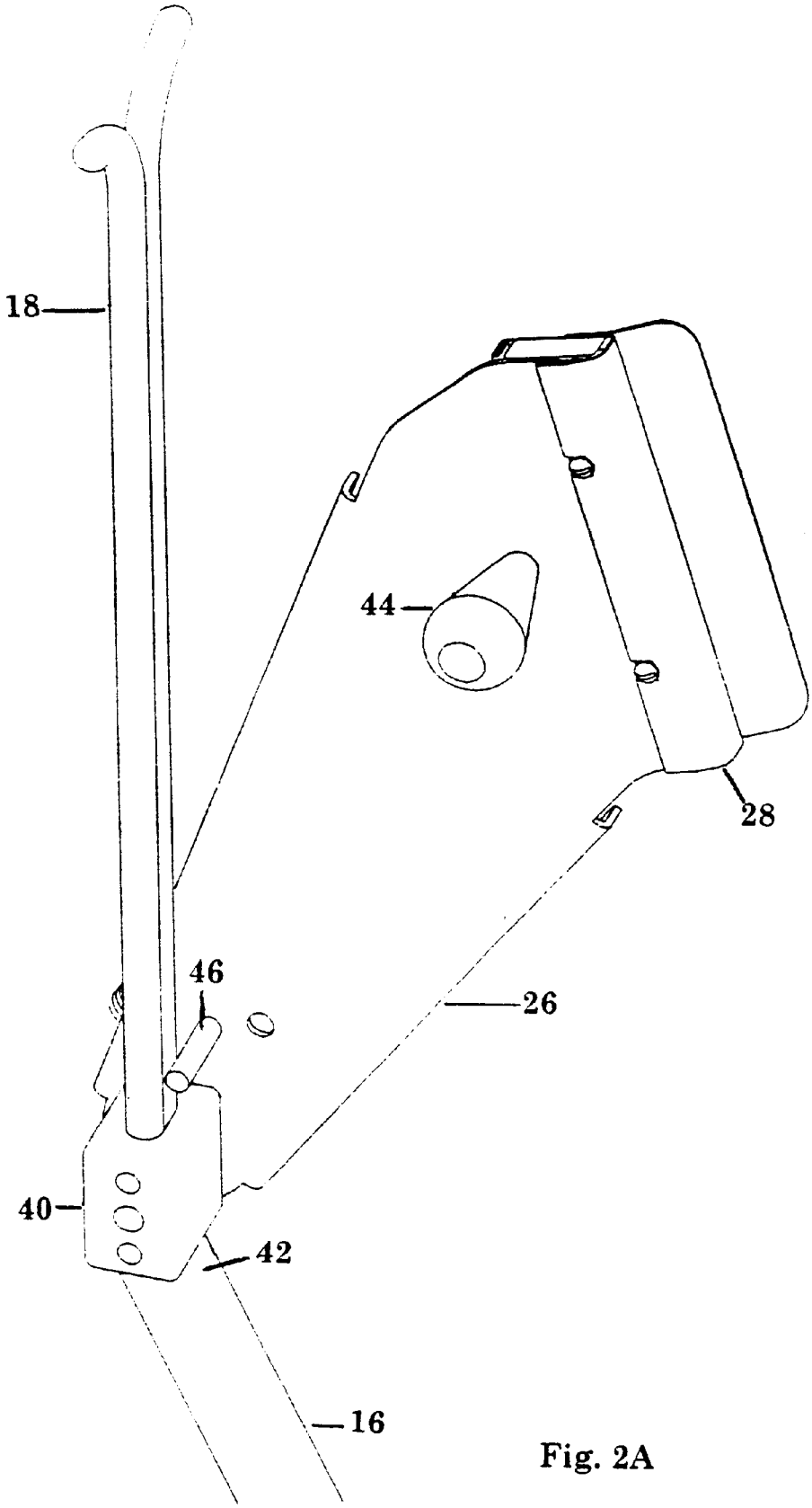
FIG. 2A is a blown up view of the clamp of the present invention in a load position.

FIG. 2A is a blown up perspective view of the clamp of the present invention in a load position. The clamp 26 is attached to the elongated arm 16 at the point of transition 42 through a joint 40. The joint 40 is located below clip 18.

In FIG. 2A, the second stopping pin 46 on clamp 26 is against the lower end of clip 18. Whereas, the first stopping pin 44 on clamp 26 is not in use. In this upward-load position, clamp 26 is ready to receive the end of a short sleeve of a short sleeve garment in the resiliently urged end 28.

Figure 2B:
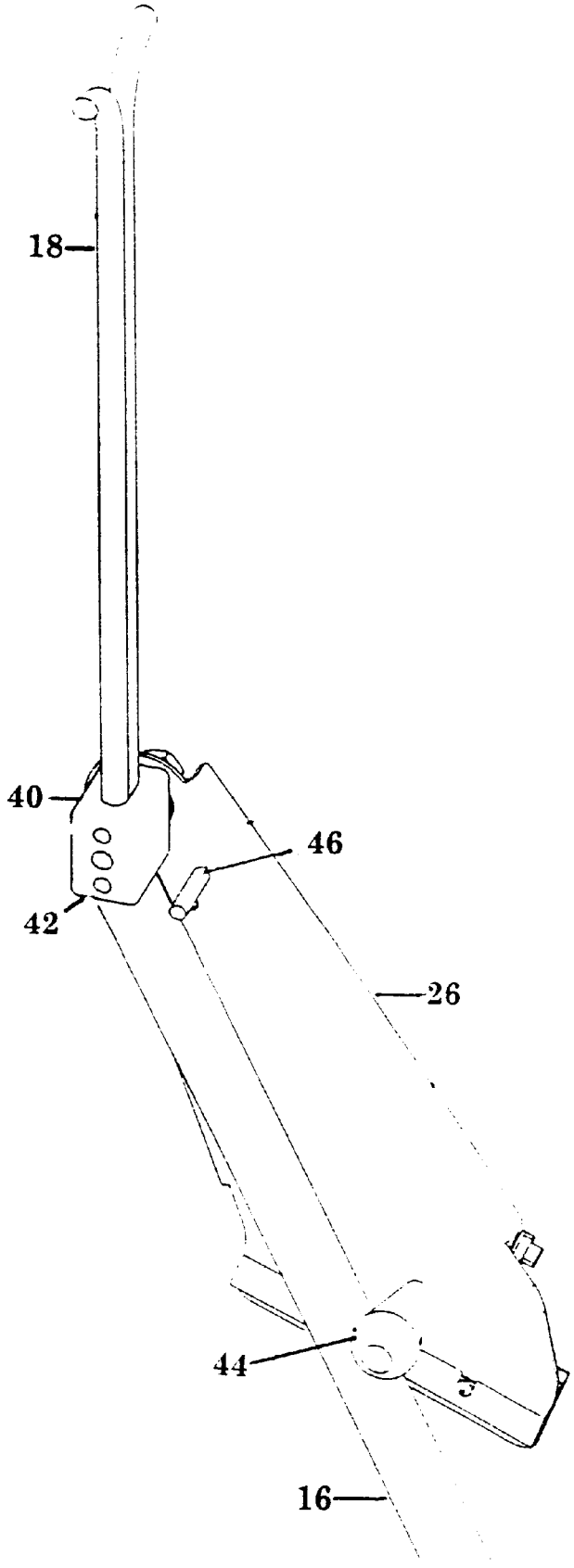
FIG. 2B is a blown up view of the clamp of the present invention in a retracted position.

FIG. 2B is a blown up perspective view of the clamp of the present invention in a retracted position. The clamp 26 is attached to the elongated arm 16 at the point of transition 42 through a joint 40. The joint 40 is located below clip 18. In FIG. 2B, the first stopping pin 44 on clamp 26 is against the elongated arm 16. Whereas, the second stopping pin 46 on clamp 26 is not in use. In this downward-retracted position, clamp 26 is out of the way which allows clip 18 to receive the end of a long sleeve of a long sleeve garment.

Figure 3:
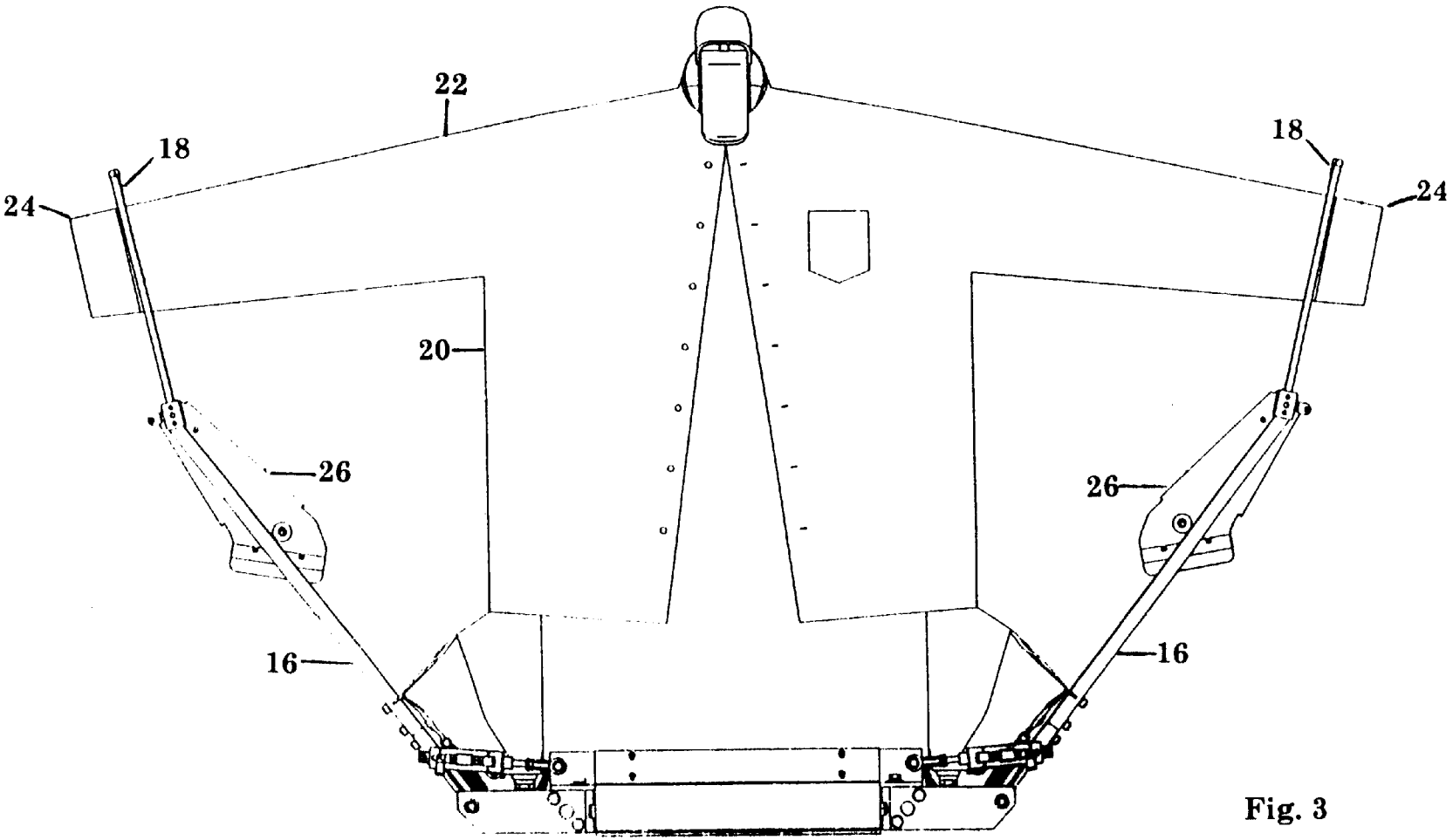
FIG. 3 is a perspective view of the preferred embodiment of the new and improved apparatus with a long sleeve garment on the pressing apparatus.

As best shown in FIG. 3, clamp 26 is positioned along the length of each of the elongated arms 16. Each clamp 26 is in a downward-retracted position. In this arrangement, the apparatus is ready to press long sleeve garments as shown. The clip 18 receive the cuffs 24 of a long sleeve 22 of a long sleeve garment 20. Each clip 18 forms an obstruction for the flow of heated air and steam therethrough during a finishing operation.

Figure 4:
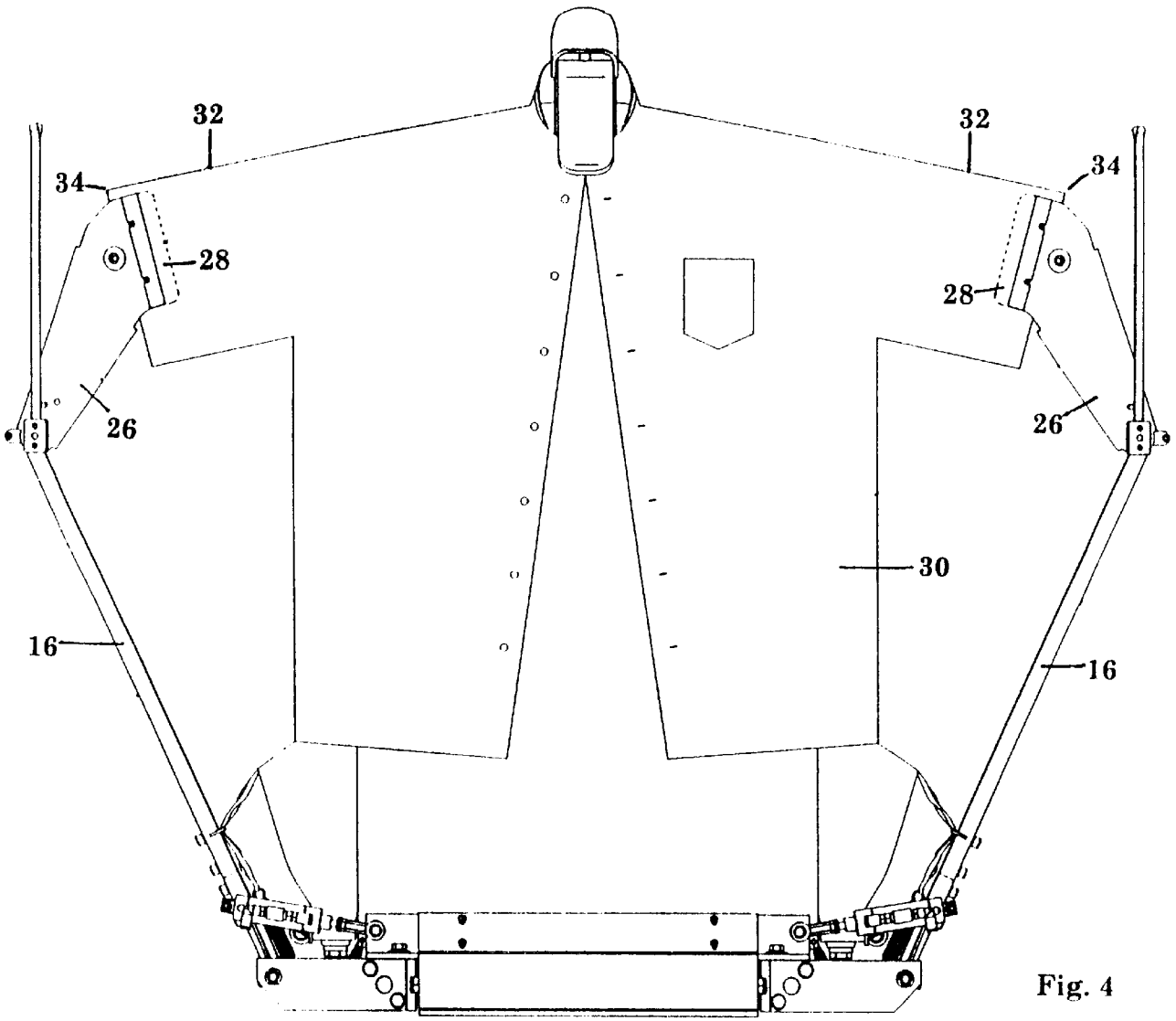
FIG. 4 is a perspective view of the preferred embodiment of the new and improved apparatus with a short sleeve garment on the pressing apparatus.

As best shown in FIG. 4, clamp 26 is positioned along the length of each of the elongated arms 16. Each clamp 26 is in an upward-load position. In this arrangement, the apparatus is ready to press short sleeve garments as shown.

Each clamp 26 has a resiliently urged end 28 adapted to receive an end 34 of a short sleeve 32 of a short sleeve garment 30. Each clamp 26 forms an obstruction for the flow of heated air and steam therethrough during a finishing operation.

Accordingly, the pressing apparatus of the present invention may be used to press long sleeve garments and alternatively, upon use of the clamps, short sleeve garments.

The sequence of operation involves four major functions. First, the operator must load the garment onto the pressing apparatus. Second, the operator must place the sleeves in the appropriate holder. Specifically, the operator must place the long sleeves of a long sleeve garment in the clips provided at the upper end of the elongated arms. Or, the operator must place the short sleeves of the a short sleeve garment in the clamp that is the improvement of the present invention. Third, the operator starts the pressing apparatus to transfer the buck in from the loading zone to the finishing zone, whereat the garment is pressed and its respective sleeves are finished, and then the buck is transferred out wherein the buck is moved from the finishing zone to the loading zone. Fourth, the operator unloads the garment from the pressing apparatus and the cycle begins anew.

A preferred method of the present invention starts with providing a buck in the general form of a wearer on a pressing apparatus for finishing garments. The buck has a front and a back and opposite lateral sides therebetween and is adapted to hold at least a front and back of the garment in an orientation for being pressed.

A pair of elongated arms are provided that are positioned on the opposite lateral sides of the buck. In the load position, the pair of elongated arms are contracted towards the opposite sides of the buck.

If the garment is long sleeved then the operator places an end of each long sleeve in a clip positioned at an upper end of each of the elongated arms.

The operator starts the pressing apparatus. At this point, the pair of elongated arms are extended away from the buck. This extends the long sleeves of the garment in preparation for the finishing operation. Then, the buck is transferred from the load position to the finishing position where heated air and steam are sent through the long sleeve garment to finish the garment.

Next, the buck is transferred from the finishing position to the load position. The pair of elongated arms are contracted towards the buck. At this point, the long sleeve garment can be taken off of the apparatus and the next garment can be loaded.

Alternatively, the operator can place a short sleeve on the buck of the pressing apparatus of the present invention. In this case, the operator moves the clamp of the present invention from a downward-retracted position to an upward-load position.

In a preferred embodiment, the clamp is rotated from the downward-retracted position to an upward-load position. The clamp is rotatably attached to the elongated arms by providing a joint on each of the elongated arms at a point of transition. Further, a first stopping pin is provided to assist the operator in placing the clamp in the correct downward-retracted position and a second stopping pin is provided to assist the operator in placing the garment in the upward-load position.

Next, the operator places an end of each short sleeve of the short sleeve garment into the resiliently urged end of the clamp.

The operator starts the pressing apparatus. At this point, the pair of elongated arms are extended away from the buck. This extends the short sleeves of the garment in preparation for the finishing operation. Then, the buck is transferred from the load position to the finishing position where heated air and steam are sent through the short sleeve garment to finish the garment.

Next, the buck is transferred from the finishing position to the load position. The pair of elongated arms are contracted towards the buck. At this point, the short sleeve garment can be taken off of the apparatus and the next garment can be loaded.

In another preferred embodiment, a piston is provided to hold the elongated arms in a contracted-load position against the opposite sides of the buck. When the piston is deactivated, the pair of elongated arms extend away from the opposite sides of the buck to a extended-finishing position as a result of gravity.

The present invention includes the apparatus as described above as well as the method for concurrently pressing the front and back of both long sleeve and short sleeve garments. The method includes the steps of providing the apparatus as described above as well as using such apparatus in the manner as described above. The method also includes the step of applying positive air pressure to the buck when in the finishing zone and applying negative air pressure when the buck is in the loading zone.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

We claim:

1. An improved pressing apparatus of the type in which a buck is adapted to hold at least a front and back of a long sleeve garment, and in which a clip is positioned at an upper end of a pair of elongated arms that extend the sleeves of the long sleeve garment away from opposite sides of the buck, wherein the improvement comprises:

a clamp positioned along the length of each of the elongated arms, each of said clamps having a resiliently urged end adapted to receive an end of a short sleeve of a short sleeve garment to form an obstruction for the flow of heated air and steam therethrough during a finishing operation, whereby the pressing apparatus may be used to press long sleeve garments and alternatively, upon use of the clamps, short sleeve garments.

2. The apparatus of claim 1 wherein each of said clamps connect to each of the elongated arms through a joint positioned at a point of transition on each of the elongated arms.

3. The apparatus of claim 2 wherein each of said clamps further comprises:

a first stopping pin for positioning each of said clamps in a retracted position on each of the elongated arms; and a second stopping pin for positioning each of said clamps in a loading position on each of the elongated arms.

4. The apparatus of claim 1 wherein the pair of elongated arms are extended through gravity to a pressing position and contracted through a piston to a loading position.

5. In a method of pressing a pair of long sleeves on a long sleeve garment of the type wherein the long sleeve garment is placed on a buck adapted to hold at least a front and back of the long sleeve garment, and each of the long sleeves of the long sleeve garment are extended away from opposite sides of the buck through a clip positioned at an upper end of a pair of elongated arms, the improvement comprising:

contracting the pair of elongated arms towards said buck;

placing a short sleeve garment having a pair of short sleeves onto the buck;

positioning a clamp on each of the elongated arms into a load position, said clamps being positioned along the length of the pair of elongated arms;

placing an end of each of the short sleeves of the short sleeve garment into the respective clamp;

extending the pair of elongated arms away from said buck;

flowing heated air and steam through the short sleeve garment during a finishing operation; and contracting the pair of elongated arms towards said buck to unload the short sleeve garment.

6. The method of claim 5 further comprises providing a joint on each of the elongated arms at a point of transition.

7. The method of claim 6 further comprises connecting each of said clamps to each of the elongated arms at the respective joint.

8. The method of claim 7 further comprising:

providing a first stopping pin on each of the elongated arms for positioning each of said clamps in a retracted position; and providing a second stopping pin on each of the elongated arms for positioning each of said clamps in a load position.

9. The method of claim 5 further comprising:

extending the pair of elongated arms through gravity to a pressing position; and contracting the pair of elongated arms through a piston to a loading position.

10. A pressing apparatus for finishing a sleeve of a garment comprising, in combination:

a buck in the general form of a wearer having a front, a back and opposite lateral sides therebetween and adapted to hold at least a front and back of the garment in an orientation for being pressed;

a pair of elongated arms positioned on opposite lateral sides of the buck, said elongated arms extending away from said buck to finish the sleeve of the garment and said elongated arms contracting towards said buck to load and unload the garment;

a clip positioned at an upper end of each of said elongated arms, each of said clips being formed with resiliently urged fingers and adapted to receive an area of a long sleeve of the garment on the buck to be finished at the region at the end of the long sleeve to form an obstruction for the flow of heated air and steam therethrough during a finishing operation; and a clamp positioned along the length of each of said elongated arms, each of said clamps having a resiliently urged end adapted to receive an area of a short sleeve of the garment on the buck to be finished at the region at the end of the short sleeve to form an obstruction for the flow of heated air and steam therethrough during the finishing operation, whereby the pressing apparatus may be used to press long sleeve garments and alternatively, upon use of the clamps, short sleeve garments.

11. The apparatus of claim 10 wherein each of said clamps connect to each of said elongated arms through a joint positioned at a point of transition on each of said elongated arms.

12. The apparatus of claim 11 wherein each of said clamps further comprises:

a first stopping pin for positioning each of said clamps in a retracted position on each of said elongated arms; and a second stopping pin for positioning each of said clamps in a loading position on each of said elongated arms.

13. The apparatus of claim 11 wherein said pair of elongated arms being extended through gravity to a pressing position and contracted through a piston to a loading position.

14. A method for finishing a pair of sleeves on a garment comprising:

providing a buck in the general form of a wearer having a front and a back and opposite lateral sides therebetween and adapted to hold at least a front and back of the garment in an orientation for being pressed;

providing a pair of elongated arms positioned on the opposite lateral sides of the buck;

contracting said pair of elongated arms towards said buck;

placing an end of each long sleeve of a long sleeve garment in a clip positioned at an upper end of each of said elongated arms, extending said pair of elongated arms away from said buck;

flowing heated air and steam through the long sleeve garment during a finishing operation;

contracting said pair of elongated arms towards said buck to unload the long sleeve garment;

placing an end of each short sleeve of a short sleeve garment in a clamp positioned along the length of each of said elongated arms;

extending said pair of elongated arms away from said buck;

flowing heated air and steam through the short sleeve garment during the finishing operation; and contracting said pair of elongated arms towards said buck to unload the short sleeve garment.

15. The method of claim 14 further comprises providing a joint on each of said elongated arms at a point of transition.

16. The method of claim 15 further comprises connecting each of said clamps to each of said elongated arms at the respective joint.

17. The method of claim 16 further comprising:

providing a first stopping pin on each of said elongated arms for positioning each of said clamps in a retracted position; and providing a second stopping pin on each of said elongated arms for positioning each of said clamps in a load position.

18. The method of claim 14 further comprising:

extending said pair of elongated arms through gravity to a pressing position; and contracting said pair of elongated arms through a piston to a loading position.

* * * * *